United States Patent [19]

Kobayasi

[11] 4,268,260

[45] May 19, 1981

[54] FEEDING MECHANISM OF BAG MANUFACTURING MACHINE

[75] Inventor: Sohei Kobayasi, Yokohama, Japan

[73] Assignees: Modern Machinery Company, Ltd.; Small Business Promotion Corporation, both of Japan

[21] Appl. No.: 53,346

[22] Filed: Jun. 29, 1979

[30] Foreign Application Priority Data

Jun. 29, 1978 [JP] Japan ..... 53-77975

[51] Int. Cl.[3] ..... B31B 1/16; B31B 1/64

[52] U.S. Cl. ..... 493/194; 493/203; 493/205; 493/239; 156/583.5

[58] Field of Search ..... 93/33 H, 33 R, DIG. 1, 93/8 R; 156/583.5, 515

[56] References Cited

U.S. PATENT DOCUMENTS

| | | | |
|---|---|---|---|
| 2,720,246 | 10/1955 | Piazze | 156/583.5 X |
| 3,147,168 | 9/1964 | Bateman | 156/583.5 X |
| 3,418,193 | 12/1968 | Hallowell, Jr. | 156/583.5 |
| 3,867,873 | 2/1975 | Simpson et al. | 93/33 H |
| 3,954,371 | 5/1976 | Hutt et al. | 93/33 H X |

*Primary Examiner*—James F. Coan

[57] ABSTRACT

The present invention relates to a feeding mechanism for a bag manufacturing machine, in which a continuously fed film strip which has been folded double is cut to predetermined lengths to manufacture bags. The feeding mechanism includes a bar for forming film loops which is projectively provided on a number of transfer bodies which move in a circulation path, and is adapted to transfer the film in a looped state by the circulation of the transfer bodies and clamp the film before heat-sealing and cutting steps, thereby to precisely control film dimension.

3 Claims, 3 Drawing Figures

FEEDING MECHANISM OF BAG MANUFACTURING MACHINE

BACKGROUND OF THE INVENTION

In order to manufacture bags continuously from a plastics strip-shaped film, the strip-shaped film is generally folded double, successively heat-sealed and then out along predetermined lengths to manufacture the individual bags. In such a manufacturing process, it is advantageous if the film is formed into loops by bending it in a zig-zag shape at the time of feeding to control the dimensions of the film and minimize the size of the apparatus. In the particular art, a device is known in which a film is formed into loops using two sets of rotating drums. This device is equipped with a mechanism in which film supporting members are arranged on the surface of respective drums at a predetermined pitch, these supporting members being made to mesh with one another by the rotation of mutually opposing drums. However, with the arrangement employing the abovementioned rotating drums, there is a problem that the meshing condition of the supporting members is restricted by the rotating movement of the drums. For instance, the length of the loops decided by the meshing depth of the supporting members, and the amount of the meshing depends on the eccentricity among the rotating shafts.

SUMMARY OF THE INVENTION

This invention relates to a feeding apparatus for a bag manufacturing machine, having a mechanism for forming loops of film, and a circulation mechanism for repeating the operation of supporting members which is separated from the loop forming mechanism, the apparatus being adapted such that the loops can be set freely without restriction by the circulatory action of the supporting members, and such that a clamping mechanism can be added thereto. The feeding apparatus of the invention is characterized by the following structural elements:

(a) A circulation path mounted in parallel to the conveyance path of the film.

(b) A plurality of transfer bodies which move in the circulation path.

(c) The transfer body being equipped with the following elements:

(i) A carrier bar projecting to the side of the circulation path and forming a film conveyance path with mutually adjacent carrier bars.

(ii) A tension bar projecting to the side of the circulation path moving through the space between mutually adjacent carrier bars and defining a path which crosses the film conveyance path.

(iii) A device for clamping the film by pressing it against the carrier bars.

DETAILED DESCRIPTION OF THE INVENTION

Figure 1:
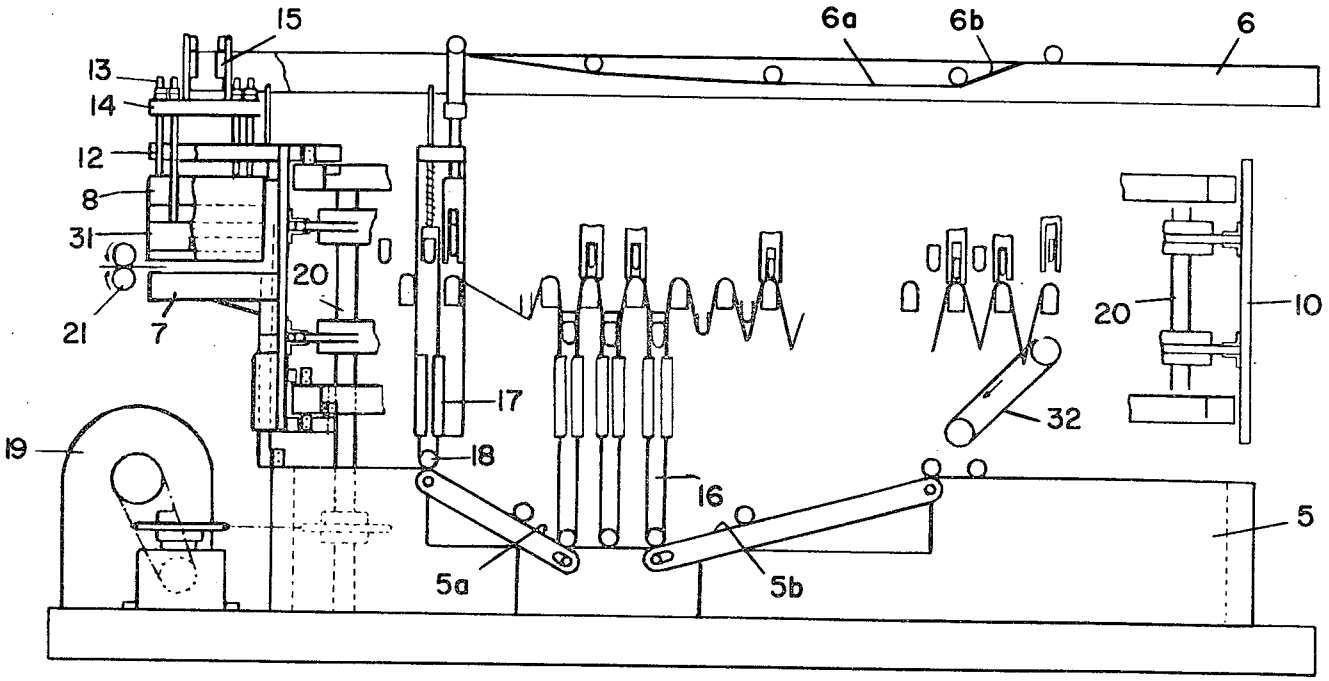
FIG. 1 is a schematic view of a feeding apparatus embodying this invention.
Figure 2:
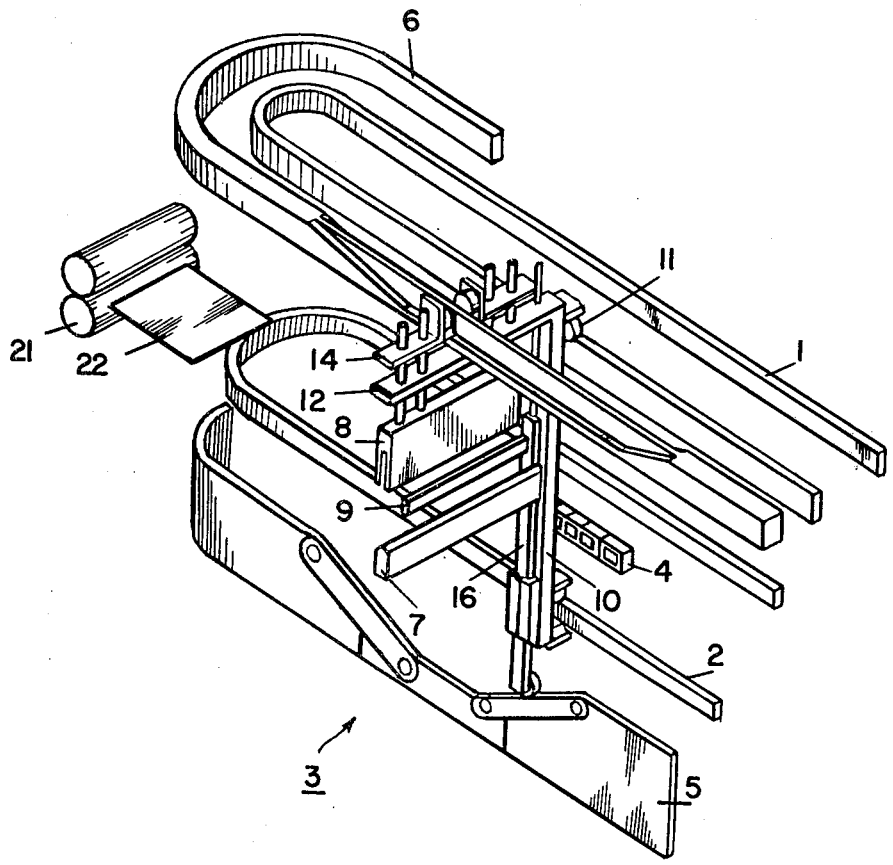
FIG. 2 is a partial perspective view of said feeding apparatus.

The invention will now be described with reference to the accompanying drawings illustrating an embodiment of an apparatus of the invention. Annular guide rails 1 and 2 are disposed side by side on the side of a film conveyance path to form a horizontal circulation path which is parallel to the film conveyance plane. The circulation path guides a transfer body 3 along the film conveyance path and also returns the transfer body 3 to the operating position when it has completed a film supporting operation, a large number of these transfer bodies 3 being connected by a chain 4 and depending from the circulation path. In order to move transfer body 3 in a stable condition along the circulation path, the guide rails 1 and 2 are mounted in parallel above and below the circulation path with the transfer body 3 being supported at two points at the top and bottom. Further, a first belt-shaped cam 5 and a second belt-shaped cam 6 are provided respectively along the circulation path to guide the transfer body 3 therealong. On the other hand in order to convey the film by the motion of the transfer body 3 along the path as well as to form a loop in the film, between the adjacent transfer bodies 3 located before and behind, the transfer body 3 comprises a carrier bar 7 projecting to the outside of the circulation path, a control block 8 vertically movable in opposition to the carrier bar 7, a tension bar 9 vertically movable at the side of the carrier bar 7, and a base plate 10 which vertically supports the carrier bar 7, control block 8 and tension bar 9 in parallel. The base plate 10 is vertically mounted, and has wheels 11 mounted at its upper and lower ends on the inner side, the wheels 11 being in rotating contact with the guide rails 1 and 2. The carrier bar 7, control block 8 and tension bar 9 are mounted in parallel on the base plate 10 and project to the outside of the circulation path. The condition in which the carrier bar etc. mounted is as shown in FIG. 1 and FIG. 2. Firstly, arm 12 projecting to the outside of the circulation path is provided at the top end of the base plate 10, the carrier bar 7 supporting the film is secured below the arm 12, and the control block 8 for clamping the film is disposed between the arm 12 and the carrier bar 7. The control block 8 is connected to a horizontal plate 14 through rods 13 which pass through the arm 12 so that the control block 8 can move vertically toward the carrier bar 7 to come into pressured contact with its upper surface, and a cam follower 15 in rotating contact with the second cam 6 is mounted on the upper surface of the horizontal plate 14, the horizontal plate 14 and control block 8 depending together as one body via the cam follower 15. On the other hand, the tension bar 9 is adapted to form a loop in the film by drawing it downward and is mounted on the base plate 10 through a slide plate 16 which slides on the side surface of the base plate 10 so as to vertically move the tension bar 9 at the side of the control block 8 and the carrier bar 7. The slide plate 16 is fitted in a sleeve 17 of the base plate 10, the bottom end of the slide plate projecting downward from the base plate 10 and having a cam follower 18 in rotating contact with the first cam 5, the slide plate 16 being supporting by the first cam 5 so as to be guided up and down. The first cam 5 is provided with an inclined guiding surface **5*a* which lowers the tension bar 9 from the upper end to the lower end of the carrier bar 7 between the film loop forming position "A" and the clamp starting position "C", and with an inclined guiding surface 5b which raises the tension bar 9 to the upper end of the carrier bar 7 between the clamp starting position "C" and the clamp releasing position "G". The second cam 6, in order to support the depending control block 8 so that the block 8 can undergo vertical motion following the vertical motion of the tension bar 9, is provided with an inclined guiding surface 6a which lowers the control block 8 to the upper surface of the carrier bar 7 from the loop forming advance position "B" to the clamp starting position "C" and which keeps the block 8 in the lowered condition between the clamp starting position "C" and the heat-seal and cutting finishing position "F", and with an inclined guiding surface 6b which raises the control block 8 above the carrier bar 7 from the heat-seal and cutting finishing position "F" to the clamp releasing position "G". On the other hand, for driving the transfer bodies 3 a sprocket 20 linked to a motor 19 is provided at a corner of the circulation path to mesh with and hence drive the transfer bodies 3 which are linked to one another by the chain 4. Furthermore, pinch rolls 21 and a guide plate 22** which feed the film in a direction parallel to the circulation path on the conveyance path of the film are provided at a position located just before the loop forming starting position "A".

Figure 3:
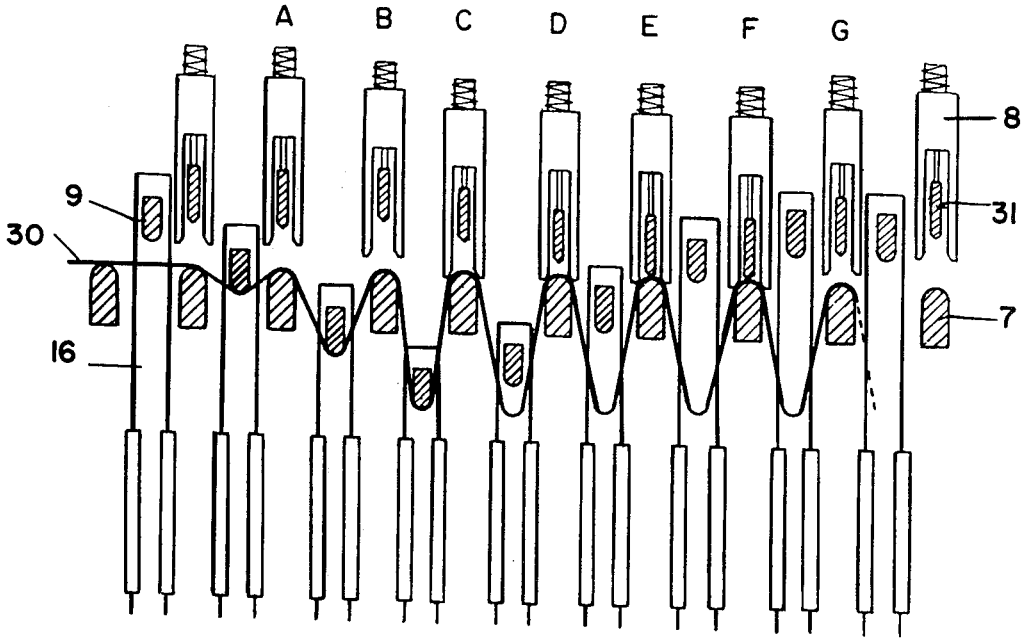
FIG. 3 is a view useful for describing the operating condition of said feeding apparatus.

The transfer body 3 being transferred around the corner of the circulation path crosses the film 30 fed by the pinch rolls 21 at a position where the transfer body advances approximately in parallel with the conveyance path of the film 30, whereby the carrier bar 7, control block 8 and tension bar 9 laterally cross the film 30. In this case, the tension bar 9 and the control block 8 are located above the carrier bar 7, and the film 30 is supported by the carrier bar 7. During the movement of the transfer body 3 to the position "A" shown in FIG. 3, the tension bar 9 starts to descend under the guidance of the inclined surface 5a of the first cam 5, thereby drawing down the film 30 supported by the carrier bar 7. As the transfer body 3 advances to the position "B", the tension bar 9 descends further to a point below the carrier bar 7, thereby forming loops in the film 30 between mutually adjacent carrier bars 7. When the transfer body 3 comes to the position "C", the tension bar 9 reaches bottom dead center, thereby to regulate the film 30 to a predetermined length. In response to the descent of the tension bar 9, the control block 8 starts to descend under the guidance of the inclined surface 6a of the second cam 6 during the movement of the transfer body 3 from position "B" to the position "C", and at the position "C" comes into pressured contact with the carrier bar 7 to clamp the film 30 into the shape of a loop. As regulation by the tension bar 9 becomes unnecessary after clamping of the film 30, the tension bar 9 starts to ascend under the guidance of the inclined surface 5b during the advance of the transfer body 3 from the position "C" to the position "D" and releases the film from the dimensional regulation. On the other hand, the control block 8 maintains the clamped condition owing to the second cam 6, and is transferred to the heat-sealing and cutting steps under this condition. As a heat-sealing mechanism, a sealing bar 31 having a heating element can be provided inside the control block 8 as shown in the FIG. 1. In the case of such a heat-sealing device, the sealing bar 31 is lowered while the clamping continues at the positions "D" and "F", and is pressed against the film 30 at the position "E" after the film has been released from the dimensional restriction, whereby the film 30 is heat-sealed and cut during the advance of the transfer body 3 to the position "F". Upon completion of the heat-sealing and cutting at the position "F", the control block 8 ascends under the guidance of the inclined surface 6b of the second cam 6 during the advancement of the transfer body 3 from the position "F" to the position "G", and clamping is released. In this case, the bag produced by the heat-sealing and cutting operation is dropped from the carrier bar 7, picked up and fed to the outside by a conveyor 32. Next, the transfer body 3 is moved around the circulation path along the guide rails 1 and 2, and again returns to the feeding position of the film 30.

The feeding mechanism of this invention as described above can freely set the dimensions of the film 30 without being restricted by the transfer condition of the transfer body 3. This is because the mechanism that moves the transfer body 3 is independent of the loop forming mechanism including the carrier bar 7 etc. In addition, the dimensional regulation of the film 30 can be achieved with high accuracy due to the provision of the mechanism that clamps the film 30 into a looped configuration before the heat-sealing and cutting steps.

I claim:

1. A feeding mechanism for a bag manufacturing machine, comprising:

(a) a circulation path mounted in parallel to a film conveyance path on a horizontal plane, (b) a plurality of transfer bodies which are rotatably supported and suspended in said circulation path;

(c) each of said transfer bodies having:

(i) a carrier bar projecting almost horizontally from the side of said circulation path to the outside to form the film conveyance path with mutually adjacent carrier bars;

(ii) a tension bar projecting to the outside of said circulation path, mounted to move vertically at the side of said carrier bar to draw the film supported by mutually adjacent carrier bars, thereby forming loops in the film between mutually adjacent carrier bars; and (iii) a clamp block movable to descend into pressured contact with the upper surface of said carrier bar; and (d) said circulation path being provided with a first cam rail for guiding the vertical movement of said tension bar, and a second cam rail for guiding the vertical movement of said clamp block according to the vertical movement of said tension bar, said first and second cam rails being disposed in parallel.

2. A mechanism according to claim 1, in which a sealing bar having a heating terminal is mounted for vertical movement as a heat-sealing and cutting means inside of said clamp block.

3. A mechanism according to claim 1, in which means for heat-sealing and cutting film is provided in a film clamping mechanism, the film being heat-sealed and cut while in the clamped state.

* * * * *